United States Patent [19]

Brough

[11] Patent Number: 4,581,884

[45] Date of Patent: Apr. 15, 1986

[54] TEXTILE MACHINE

[75] Inventor: Denys W. Brough, Macclesfield, United Kingdom

[73] Assignee: Rieter-Scragg Limited, Cheshire, England

[21] Appl. No.: 650,500

[22] Filed: Sep. 14, 1984

[30] Foreign Application Priority Data

Sep. 28, 1983 [GB] United Kingdom ..... 8325996

[51] Int. Cl.[4] ..... D02G 1/02; D01H 15/00

[52] U.S. Cl. ..... 57/291; 57/280; 57/290

[58] Field of Search ..... 57/284, 290, 291, 279, 57/280

[56] References Cited

U.S. PATENT DOCUMENTS

| | | | |
|---|---|---|---|
| 3,942,312 | 3/1976 | Venot | 57/290 X |
| 3,946,546 | 3/1976 | Venot | 57/291 X |
| 3,962,829 | 6/1976 | Schippers | 57/291 |
| 3,991,545 | 11/1976 | Ritter et al. | 57/290 X |
| 4,027,466 | 6/1977 | Brehm | 57/291 X |
| 4,051,650 | 10/1977 | Gleyze et al. | 57/290 X |
| 4,058,961 | 11/1977 | Kubler | 57/291 |
| 4,308,716 | 1/1982 | Bauer | 57/291 X |
| 4,362,010 | 12/1982 | Crouzet | 57/291 X |

FOREIGN PATENT DOCUMENTS

| | | | |
|---|---|---|---|
| 1458990 | 12/1976 | United Kingdom | 57/280 |

*Primary Examiner*—John Petrakes

*Attorney, Agent, or Firm*—Oblon, Fisher, Spivak, McClelland & Maier

[57] ABSTRACT

A textile machine, which comprises a stand-off creel, first, second and third feed means, first and second heaters, cooling zone, false twist device and take-up means, has the second and third feed means, false twist device, second heater and take-up means mounted on a common frame with the second heater disposed vertically behind the take-up means and the third feed means located forwardly of the second heater, and has guide means operable to guide a yarn from the outlet end of the second heater through 90° to the third feed means. This enables the second heater to be mounted lower in the frame than with previous machines and enables the false twist device, second feed means, cooling zone and first heater to be positioned nearer to the operator for operation, maintenance or cleaning.

8 Claims, 3 Drawing Figures

TEXTILE MACHINE

BACKGROUND OF THE INVENTION

This invention relates to textile machines, and in particular to a multi-station yarn texturing machine which textures yarn by false twist crimping, a process in which at each station an untextured yarn from a supply source runs over a setting heater and through a cooling zone followed by a false twister, twist being propagated upstream of the false twister and set by the heater. In the heating zone the yarn temperature is raised close to its melting point, and in the cooling zone the yarn temperature is reduced until the yarn is sufficiently stable to withstand the action of the false twister.

In drawtexturing the feed yarn is either undrawn or partially drawn and drawing is performed or completed on the texturing machine. This can be by a separate drawing step preceding false twist crimping (sequential) or by drawing at the same time as false twist crimping (simultaneous). In so-called double-heater machines for producing set yarns to which the present invention particularly relates, the yarn runs from the false twister through a secondary heater while under controlled overfeed conditions, and is then fed to the take-up devices, so that the final product is crimped yarn of low extensibility in comparison with the so-called torque stretch yarn produced by a single heater machine.

All the foregoing is well known in the art, and it has also hitherto been proposed to positively cool the yarn in the cooling zone, rather than the yarn becoming cooler merely by its exposure to the ambient atmosphere, and prior art proposals in the patents literature have included enclosures, tubes, jackets, and contact blocks on pipes, the coolants suggested being air or circulated water or like fluid.

In known yarn texturing machines, the usual arrangement is to have packages of supply yarn on a so-called "stand-off" creel, on which the supply packages are carried in tiers and columns, the usual arrangement being that each thread-line is fed from an active supply package connected to a reserve package mounted side by side in the creel.

The creel may be a wholly fixed structure or it may be at least partially movable, for example it may comprise a fixed frame with which are associated movable sub-frames each carrying a predetermined number of supply packages.

These creels tend to be relatively high since the supply packages are large, a typical stand-off creel carrying tiers of packages in columns six high being something over 2 meters in height, so that operatives need to use mobile platform step-ladders to service both the creel and the yarn texturing machine fed by the creel.

Modern machines tend to be double-sided and have a row of texturing stations along each sside, e.g. 108 stations at each side which are supplied by respective stand-off creels with an operative's aisle between each creel and the machine.

In the constant search to increase production rates by increasing yarn throughput speeds, setting heaters and secondary heaters have become progressively longer, as well as cooling zones. Currently two meter, 2.5 meter, and three meter setting heaters are already in use along with secondary heaters of 1.45 to two meters in length.

In machines where the yarn runs downwardly through the secondary heater in a vertical path, such double-heater machines are approaching six meters in height, and as well as the obvious disadvantages which follow from such vast height, there are undesirable lengths of yarn running in uncontrolled manner from the creel to the top ends of the setting heaters. Conventionally the secondary heaters are placed behind the take-up devices and the third feed devices through which the yarns run are located beneath the secondary heaters to receive the yarns therefrom and feed them forwardly of the machine to the front of the take-up devices.

The object of this invention is to provide a yarn texturing machine of reduced height and without the disadvantage of uncontrolled running yarn lengths, but which incorporates high throughput speeds, and hence long heater and cooling plate lengths, and large diameter supply and take-up packages.

The invention provides a textile machine having a supply means for at least one yarn and in sequence for the or each yarn a first feed means, a primary heater, a cooling zone, a false twist device, a second feed means, a secondary heater, a third feed means and a take-up device, wherein said false twist device, said second feed means, said secondary heater, said third feed means and said take-up device are mounted in a common frame of said machine with said secondary heater disposed in a substantially vertical position behind said take-up device, said third feed means being located forwardly of said secondary heater and said machine comprising guide means adapted to guide said yarn from the lower end of said secondary heater to said third feed means.

The guide means may comprise a tube assembly which may provide a yarn path which is bent through substantially 90°. Said tube asssembly may be detachably mounted in said machine.

The third feed means may comprise a feed roller and a nip roller forming a nip therewith through which the yarn passes. The nip roller may be disposed beneath said feed roller.

The machine may also comprise traverse means operable to traverse the yarn laterally of said nip, and said traverse means may also be disposed forwardly of said secondary heater.

By means of the invention the secondary heater may be disposed lower than was the case heretofore whilst maintaining or improving accessibility to the third feed means and the traverse means associated therewith. In consequence of the lowering of the secondary heater the second feed means, false twist device, the cooling zone and the primary heater may all be lowered relative to the prior arrangements, thereby enabling such devices more readily accessible to the machine operator.

In fact it has been found that these devices can be readily serviced by an operator standing on a two-step trolley instead of a three-step trolley as was previously required, whilst large diameter take-up packages, of up to 30 can still be produced. This represents a considerable saving of effort for the operator over a working day and consequently improves operating efficiency.

BRIEF DESCRIPTION OF THE DRAWINGS

The invention will now be described with reference to the accompanying drawings in which.

DETAILED DESCRIPTION OF THE PREFERRED EMBODIMENTS

Figure 1:
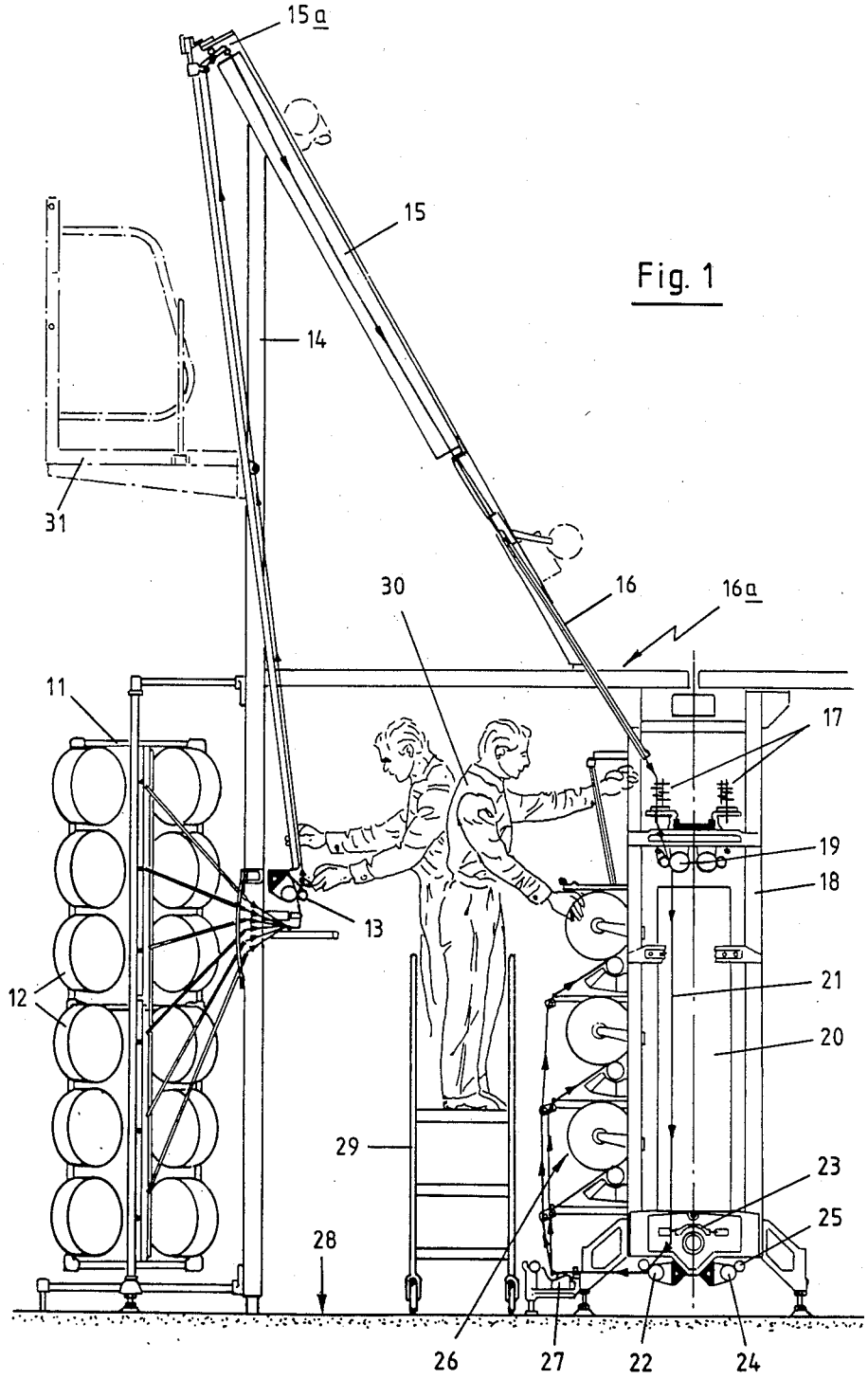
FIG. 1 is a threadline diagram of a previously known textile machine.

Referring now to FIG. 1 there is shown a textile machine 10 comprising a stand-off creel 11 containing yarn supply packages 12 and having first yarn feed means 13 mounted thereon. Spaced uprights 14 of the machine 10 support the inlet ends 15*a* of primary heaters 15 which are inclined downwardly towards respective cooling plates 16, so that a substantially straight yarn path is provided between the inlet 15*a* of yarn heater 15 and the false twist device 17 located adjacent the outlet ends 16*a* of cooling plates 16. The outlet ends 16*a* of cooling plates 16 and the false twist devices 17 are mounted on the central frame 18 of the machine 10, and the second feed means 19 are also mounted on frame 18 beneath the false twist devices 17.

Disposed beneath false twist devices 17 and second feed devices 19 within the frame 18 are secondary heaters 20 through which the yarns 21 travel in a substantially vertically downward direction. Beneath secondary heaters 20 are third feed means 22 and the traverse means 23 associated therewith. The third feed means 22 comprise feed rollers 24 and nip rollers 25 disposed above and forwardly thereof to feed the yarns 21 forwardly of the machine frame 18 to the take-up devices 26 mounted in front of the secondary heaters 20. The traverse devices 23 effect lateral traversing of the yarns 21 relative to the nips formed between the feed rollers 24 and nip rollers 25 to reduce the wear thereof. Yarn oiling devices 27 are disposed between the third feed devices 22 and the take-up devices 26.

In order that yarn processing signals may be as high as possible for economic reasons the secondary heaters 20 are relatively long to provide the requisite temperature rise to set the yarns as they pass therethrough. In consequence the second feed means 19, the false twist devices 17 and the outlet ends 16*a* of cooling plates 16 are at such a height above the floor 28, that the use of a three step trolley 29 by the operator 30 is necessary in order to service those parts of the machine 10. In addition the inlet ends 15*a* of primary heaters 15 are at a considerable height above floor 28 so that an upper walkway 31 is required in order to gain access to heater inlets 15*a* for servicing purposes.

For these reasons the arrangement shown in FIG. 1 and other similar arrangements are not entirely satisfactory from the ergonomic point of view.

Figure 2:
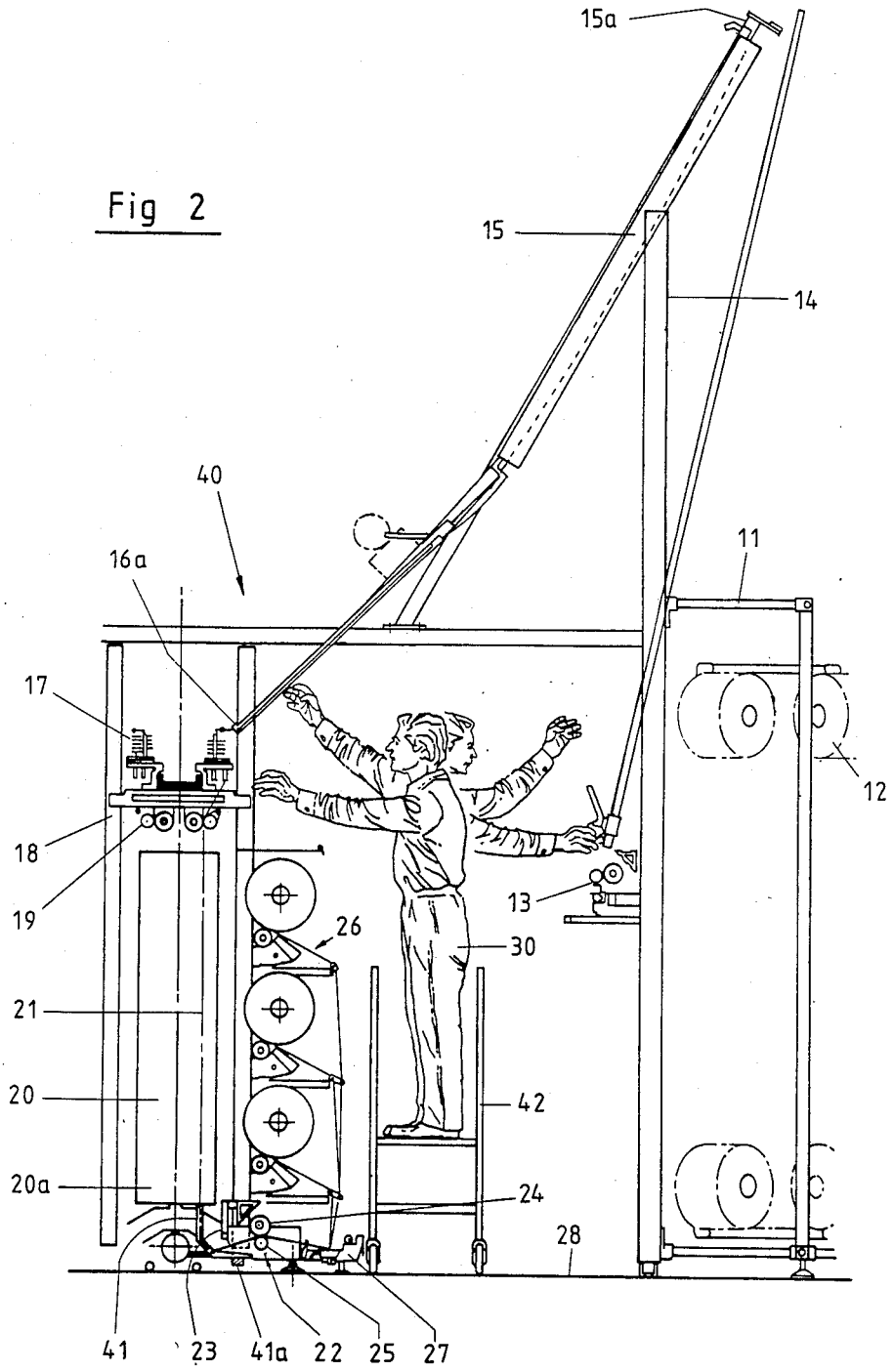
FIG. 2 is a corresponding threadline diagram of a textile machine in accordance with the invention.
Figure 3:
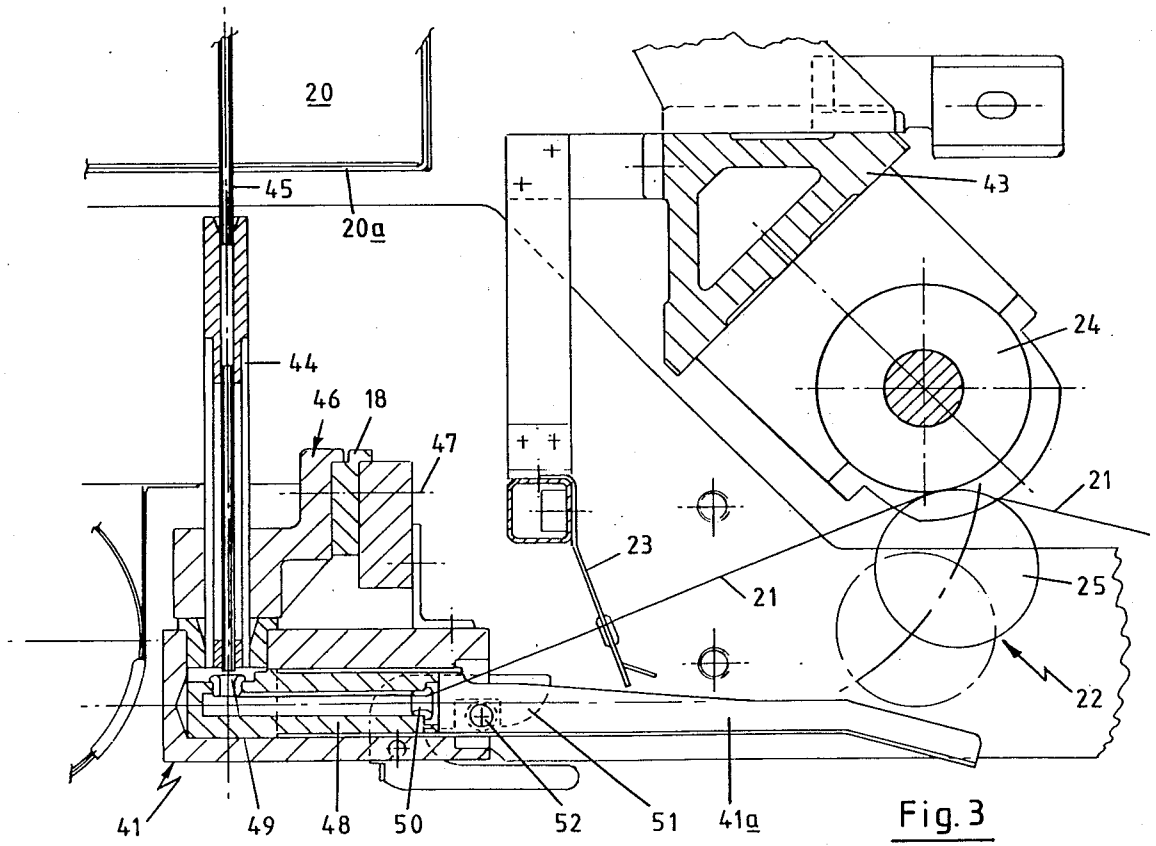
FIG 3 is a view of the guide means and third feed means of FIG. 2 to an enlarged scale.

Referring now to FIGS. 2 and 3 there is shown a textile machine 40 having parts corresponding with those of the FIG. 1 machine identified by corresponding numerals. In this case the traverse means 23 and the third feed means 22 are disposed forwardly of the secondary heaters 20 so that the latter may be mounted lower in frame 18 than was the case in the previously described machine 10. To facilitate threading of yarns 21 through the secondary heaters 20, the traverse means 23, and the third feed means 22, a guide tube assembly 41 is provided at each yarn station. The guide tube assemblies 41 are mounted at the outlet end 20*a* of the secondary heaters 20 and are formed to have 'scoop' ends 41*a* adapted to receive the end of a suction gun (not shown). By placing a suction gun in the scoop end 41*a* of a guide tube 41 a yarn 21 may be drawn through the respective secondary heater 20 and then threaded through the respective traverse means 23 and third feed means 22, the latter in particular being readily accessible to the operator 30. The guide tube assemblies 41 guide the yarns 21 through substantially 90° from the outlet ends 20*a* of heaters 20 so as to direct the yarns 21 to the traverse means 23 and feed means 22.

As with the previously described machine 10 the third feed means 22 each comprise a feed roller 24 and a nip roller 25 providing a nip therebetween through which the yarn 21 passes. However, in the arrangement of FIG. 2 the nip rollers 225 are disposed beneath the feed rollers 24. This enables a reasonable, not too angled, threadline path between the outlets 41*a* of guide tube assemblies 41 and the yarn oiling devices 27 through the nips of feed means 22, which would otherwise not be attained if the yarns 21 pass over the feed rollers 24 since the latter, with their drive, bearings and support beam 43 must of necessity be clear of the floor 28.

Referring in particular to FIG. 3 it can be seen that the guide tube assembly 41 comprises a first tube 44 in the upper end of which is received the bottom end of a tube 45 of the secondary heater 20. The first tube 44 is mounted in a block 46 which is removably secured to the frame 18 of the machine by a bolt 47. This enables the assembly 41 to be lowered and removed for maintainance purposes. Located in block 46 is a second tube 48 which has yarn guides 49,50 at the inlet and outlet ends thereof respectively. A latch 51 retains tube 48 in position, but allows it to be removed easily for cleaning of the guides 49,50. During normal operation suction is applied to tubes 48 and 44 through suction tube 52 to remove fumes from heaters 20.

The arrangement of FIGS. 2 and 3 enables the secondary heater 20 to be lower by an appreciable amount as compared to the case heretofore. In addition since the threadline path from the bottom 20*a* of heater 20 is lower than was previously the case the take-up devices 26 are also able to be lower than in prior arrangements. In consequence whilst maintaining long secondary heaters 20 and producing large diameter, i.e. 300 mm, take-up packages the height of the second feed means 19, the false twist devices 17 and the outlets 16*a* of cooling plates 16 can all be brought within the convenient servicing range of an operator 30 whilst standing on a two-step trolley 42 instead of the three-step trolley previously required.

We claim:

1. A textile machine comprising:

supply means for supplying at least one yarn;

a frame having defined therein for each said at least one yarn a yarn path along which is disposed in sequence a first feed means, a first heater, a cooling zone, a false twist device, a second feed means, a second heater having an outlet end, a third feed means and a take-up means, wherein said second feed means, said second heater, said third feed means and said take-up means are mounted in said frame with said second heater disposed in an upright position behind said take-up means, said yarn being fed downwardly through said second heater to said outlet end thereof wherein said third feed means is located forwardly of said second heater;

and guide means operable to guide the yarn from said outlet end to said third feed means, wherein said guide means comprises a block mounted in said frame adjacent said outlet end, a first tube mounted in said block and having an upper end thereof which is received by said outlet end, latching means, and a second tube detachably secured in said block by said latching means and disposed at substantially 90° to said first tube.

2. A textile machine according to claim 1 wherein said second tube has an end remote from said block formed as a scoop adapted to receive a suction gun therein for aiding the threading of a yarn through said guide means.

3. A textile machine according to claim 1 wherein said second tube has inlet and outlet ends, and yarn guides disposed at said inlet and outlet ends.

4. A textile machine according to claim 1, wherein said block is detachably mounted in said machine.

5. A textile machine according to claim 1 wherein said third feed means comprises a feed roller and a nip roller disposed beneath said feed roller and forming a nip therewith through which said yarn may pass.

6. A textile machine according to claim 5 wherein said machine comprises a traverse means disposed forwardly of said second heater and operable to traverse said yarn laterally of said nip.

7. A textile machine according to claim 1 wherein said false twist means and said second feed means are mounted in said frame above said second heater.

8. A textile machine according to claim 1 wherein said yarn supply means comprises a creel spaced from said frame, and said first heater and said cooling zone are disposed above the space between said creel and said frame.

* * * * *